US012753770B2

(12) United States Patent
Bawn et al.

(10) Patent No.: US 12,753,770 B2
(45) Date of Patent: Oct. 6, 2026

(54) LIQUID HYDROGEN PUMP IMPELLOR ASSEMBLY

(71) Applicant: ROLLS-ROYCE plc, London (GB)

(72) Inventors: John R. Bawn, St. Albans (GB); Alexander D. Szymanski, Coventry (GB)

(73) Assignee: Rolls-Royce plc, London (GB)

( * ) Notice: Subject to any disclaimer, the term of this patent is extended or adjusted under 35 U.S.C. 154(b) by 5 days.

(21) Appl. No.: 18/927,055

(22) Filed: Oct. 25, 2024

(65) Prior Publication Data

US 2025/0163928 A1 May 22, 2025

(30) Foreign Application Priority Data

Nov. 17, 2023 (GB) ..... 2317640

(51) Int. Cl.
*F04D 29/18* (2006.01)
*F04D 17/08* (2006.01)
(Continued)

(52) U.S. Cl.
CPC ..... *F04D 29/185* (2013.01); *F04D 17/08* (2013.01); *F04D 29/22* (2013.01); *F04D 29/628* (2013.01)

(58) Field of Classification Search
CPC ..... F04D 29/185; F04D 29/22; F04D 29/628; F04D 29/054; F04D 29/266; F04D 17/08;
(Continued)

(56) References Cited

U.S. PATENT DOCUMENTS 4,183,719 A 1/1980 Bozung
5,286,162 A 2/1994 Veres
(Continued)

FOREIGN PATENT DOCUMENTS

CN 102767398 A * 11/2012
DE 102016119233 A1 * 4/2018
(Continued)

OTHER PUBLICATIONS

"Aircraft Materials" Aircraft Stainless Steel BS S80 (Year: 2013).*
(Continued)

*Primary Examiner* — Ryan C Clark
(74) *Attorney, Agent, or Firm* — Shumaker & Sieffert, P.A.

(57) ABSTRACT

An impellor assembly for a liquid hydrogen pump. The assembly comprises a shaft, one or more impellors mounted to the shaft, a fastener configured to engage with the shaft at a first engagement point and with the one or more impellor at a second engagement point to axially clamp the one or more impellor to the shaft, an axially unconstrained length of the fastener being defined by an axial distance between the first and second engagement points. An axial extent of a clamped portion of the one or more impellors corresponds to the axially unconstrained length of the fastener. The fastener and the impellor comprise a material having a first coefficient of thermal expansion and the shaft comprises a material having a second coefficient of thermal expansion, wherein the first and second coefficients of thermal expansion are different.

17 Claims, 4 Drawing Sheets

(51) Int. Cl.
*F04D 29/22* (2006.01)
*F04D 29/62* (2006.01)

(58) Field of Classification Search
CPC ..... F05D 2260/30; F05D 2260/31; F05D 2300/121; F05D 2300/171; F05D 2300/502
See application file for complete search history.

(56) References Cited

U.S. PATENT DOCUMENTS

| | | | | |
|---|---|---|---|---|
| 5,529,464 | A * | 6/1996 | Emerson | F04D 29/047 415/110 |
| 6,012,901 | A | 1/2000 | Battig et al. | |
| 8,967,960 | B2 * | 3/2015 | Guenard | F04D 29/054 415/198.1 |
| 2004/0202556 | A1 * | 10/2004 | Svihla | F01D 25/166 417/407 |
| 2019/0331124 | A1 * | 10/2019 | Wallin | F04B 39/00 |
| 2022/0268292 | A1 * | 8/2022 | Nagao | F04D 29/266 |

FOREIGN PATENT DOCUMENTS

| | | | | |
|---|---|---|---|---|
| EP | 3910165 | A1 * | 11/2021 | F01D 5/025 |
| EP | 3929405 | A1 | 12/2021 | |
| JP | S5918201 | A | 1/1984 | |
| KR | 20220124982 | A * | 9/2022 | |
| WO | WO-2014088824 | A1 * | 6/2014 | F01D 25/162 |
| WO | WO-2017157368 | A1 * | 9/2017 | F01P 5/12 |

OTHER PUBLICATIONS

Merriam-Webster dictionary, "Approximately" definition. Retrieved 2025 (Year: 2025).*

"Substantially" definition Merriam-Webster; https://www.merriam-webster.com/dictionary/substantially; retreived Sep. 17, 2025 (Year: 2025).*

Great Britain search report dated Apr. 17, 2024, issued in GB Patent Application No. 2317640.7.

Response to Extended Search Report dated Mar. 24, 2025, from counterpart European Application No. 24207101.7 filed Jun. 6, 2025, 40 pp.

European search report dated Mar. 12, 2025, issued in EP Patent Application No. 24207101.7.

* cited by examiner

LIQUID HYDROGEN PUMP IMPELLOR ASSEMBLY

CROSS-REFERENCE TO RELATED APPLICATIONS

This specification is based upon and claims the benefit of priority from UK patent application number 2317640.7 filed on Nov. 17, 2023, the entire contents of which are incorporated herein by reference.

BACKGROUND

Technical Field

This disclosure relates to an impellor assembly for a liquid hydrogen pump for a liquid hydrogen fueled gas turbine engine. The disclosure also relates to pumps comprising such assemblies, gas turbine engines comprising such pumps, aircraft comprising such gas turbine engines, and methods of assembling pumps utilising such assemblies.

Description of the Related Art

In order to limit emissions of carbon dioxide, use of hydrogen as an alternative to hydrocarbon fuel in gas turbine engines has historically only been practical in land-based installations. However, more recently there has been interest in aircraft powered by hydrogen stored at cryogenic temperatures, as either a compressed gas, a supercritical fluid, or a liquid.

One challenge of such systems is the fuel pump. Liquid hydrogen pumps must be tolerant of a wide temperature range, since liquid hydrogen boils at approximately 20 Kelvin (K), but for operational convenience, and also for convenience of assembly, manufacture and servicing of the pump, the pump must be permitted to warm to ambient temperatures between uses. Such a wide temperature range may result in relative thermal expansion of components, which may result in excess stress and short operational life. The present disclosure seeks to provide a means to address these issues.

SUMMARY

In a first aspect there is provided an impellor assembly for a liquid hydrogen pump, the assembly comprising:

a shaft;

one or more impellors mounted to the shaft;

a fastener configured to engage with the shaft at a first engagement point and with the one or more impellor at a second engagement point to axially clamp the one or more impellor to the shaft, an axially unconstrained portion of the fastener being defined by a region comprising an axial distance between the first and second engagement points and defining a first length; wherein an axial extent of a clamped portion of the one or more impellors corresponds to the axially unconstrained length of the fastener; and the fastener and the impellor comprise a material having a first coefficient of thermal expansion and the shaft comprises a material having a second coefficient of thermal expansion, wherein the first and second coefficients of thermal expansion are different.

Advantageously, by providing a fastener formed of a material having the same coefficient of thermal expansion as the impellor, and having an unconstrained length corresponding to the axial length of the impellor, the impellor and shaft can be formed of different materials having different coefficients of thermal expansion, without suffering from relative thermal contraction when the assembly is cooled. Further features and advantages of the disclosed arrangement are set out below.

The fastener and impellor may be formed of a first material, and the shaft may be formed of a second material.

The coefficient of thermal expansion of the first material may be higher than that of the second material, and the coefficient of thermal expansion of the first material may be approximately two times that of the second material.

The fastener may comprise a threaded fastener. The threaded fastener may comprise a threaded portion and an unthreaded portion. The threaded portion may be spaced from a head of the fastener by the unthreaded portion, which may comprise the unconstrained length. Advantageously, the unthreaded portion is able to expand and contract axially during heating and cooling.

The threaded portion of the fastener may engage against a threaded portion of the shaft. The threaded portion of the fastener may comprise an external thread, and the threaded portion of the shaft may comprise an internal thread.

A head of the fastener may engage against the impellor at the second engagement point comprising a first axial surface of the impellor. A shoulder of the shaft may engage against a second axial surface of the one or more impellor, opposite the first axial surface.

The impellor assembly may comprise a bearing arrangement configured to rotatably support the shaft. The bearing arrangement may comprise a bearing mounted to a bearing race. The bearing race may comprise a material having approximately the same coefficient of thermal expansion as the material of the shaft.

The impellor and fastener may comprise one of 316L stainless steel and aluminium. The shaft may comprise S80 stainless steel. The bearing race may comprise Cronidur™ 30.

The impellor assembly may comprise a first impellor and a second impellor. A first axial surface of the first impellor may engage against a head of the fastener, a second axial surface of the first impellor may engage against a first axial surface of the second impellor, and a second axial surface of the second impellor may engage against a shoulder of the shaft.

The impellor assembly may comprise first, second and third impellors. Each of the impellors may comprise the first material. A first axial surface of the first impellor may engage against a head of the fastener, a second axial surface of the first impellor may engage against a first axial surface of the second impellor, a second axial surface of the second impellor may engage against a spacer, the spacer may engage against a first axial surface of the third impellor, and a second axial surface of the third impellor may engage against a shoulder of the shaft.

The spacer may comprise the second material.

The impellor may comprise one of an axial pump impellor and a centrifugal pump impellor. In one embodiment, the first impellor comprises an axial pump impellor and the second impellor comprises a centrifugal pump impellor.

In a second aspect, there is provided a liquid hydrogen pump comprising an impellor assembly according to the first aspect and a housing.

In a third aspect there is provided an aircraft propulsion system comprising a gas turbine engine and a liquid hydrogen fuel pump according to the second aspect.

In a fourth aspect there is provided an aircraft comprising a propulsion system according to the third aspect.

In a fifth aspect there is provided a method of assembly of an impellor assembly for a liquid hydrogen pump, the method comprising:

providing an impellor assembly according to the first aspect; and using the fastener to axially clamp the impellor to the shaft.

BRIEF DESCRIPTION OF THE DRAWINGS

An embodiment will now be described by way of example only with reference to the accompanying drawings, which are purely schematic and not to scale, and in which.

DETAILED DESCRIPTION

Figure 1:
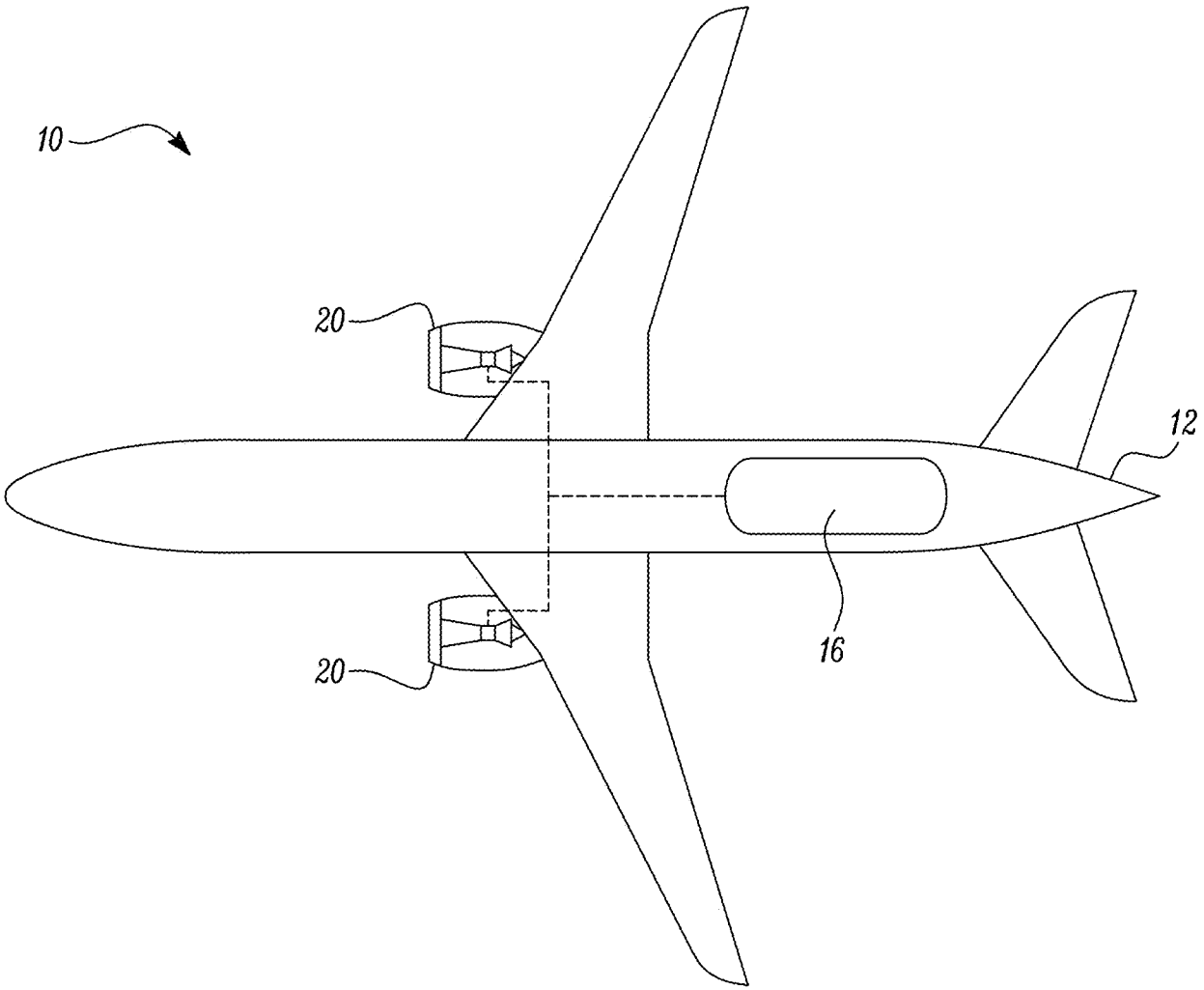
FIG. 1 shows a hydrogen-fueled airliner comprising a propulsion system comprising hydrogen-fueled turbofan engines.

A hydrogen-fueled airliner is illustrated in FIG. 1. In this example, the airliner 10 is of substantially conventional tube-and-wing twinjet configuration with a central fuselage 12 and a propulsion system comprising substantially identical underwing-mounted turbofan engines 20.

A hydrogen storage tank 16 located in the fuselage 12. The hydrogen storage tank 16 is a cryogenic hydrogen storage tank and thus stores the hydrogen fuel in a liquid state, in a specific example at 22 Kelvin. In this example, the hydrogen fuel is pressurised to a pressure from around 1 bar to around 4 bar, in a specific example 4 bar. As will be appreciated, storing the hydrogen fuel at a higher pressure would necessitate heavier tanks to contain the pressure, and increase the risk of leaks. On the other hand, a lower pressure would increase the boiling point of the hydrogen, requiring a lower temperature in the tank, and would risk cavitation in downstream hydrogen plumbing.

Figure 2:
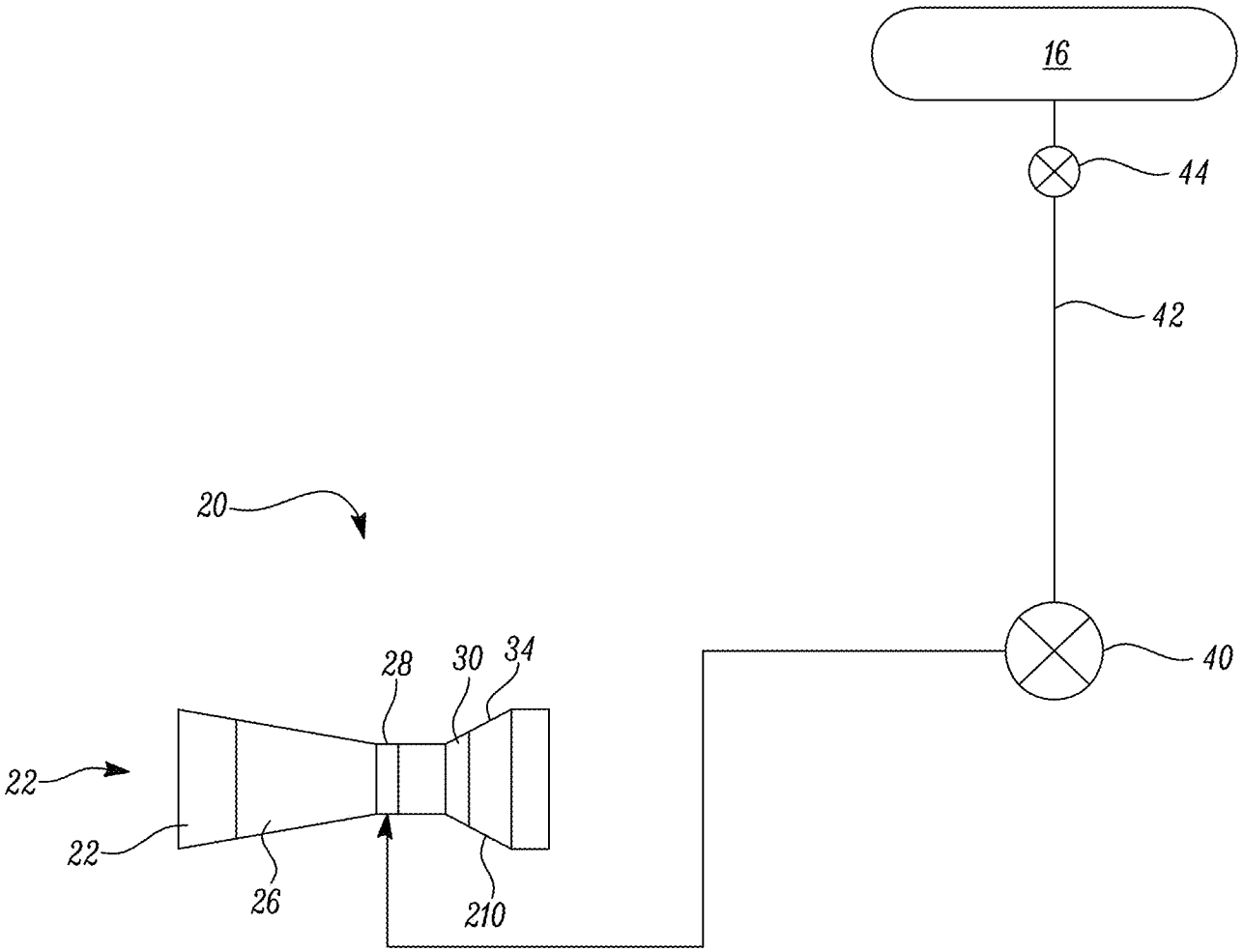
FIG. 2 is a block diagram of a fuel system of the propulsion system of the aircraft of FIG. 1.

A block diagram of one of the propulsion systems comprising one of the engines 20 is shown in FIG. 2.

The turbofan engine 20 comprises a core gas turbine 22.

The core gas turbine 22 comprises, in fluid flow series, separate low and high-pressure compressors 24, 26, a core combustor 28 and a turbine system comprising high and low-pressure turbines 30, 34. The low-pressure compressor 24 is driven by the low-pressure turbine 34 via a low-pressure shaft (not shown) and the high-pressure compressor 26 is driven by the high-pressure turbine 30 via a high-pressure shaft (not shown). A fan (not shown) is typically provided to provide propulsive thrust in addition to that generated by the engine core. It will be appreciated that in alternative embodiments, the core gas turbine could be of three-shaft configuration, and/or could comprise a reduction gearbox between the turbine and fan.

In operation, hydrogen fuel is pumped from the hydrogen storage tank 16 by a main, high-pressure hydrogen fuel pump 40 and into a main fuel conduit 42 which ultimately delivers fuel to the core combustor 28. In the present embodiment, the pump 40 is driven by an electric machine. In other embodiments, the pump 40 may be driven by one or more of the gas turbine engine core shafts via an auxiliary gearbox (not shown). In some cases, a low-pressure pump 44 may also be provided, upstream of the high-pressure pump 40, and may be provided within the liquid hydrogen tank 16.

The high-pressure hydrogen fuel pump 40 is configured to pump liquid hydrogen, rather than primarily to pump gaseous or supercritical hydrogen. As such, the fluid within the pump 40 is substantially incompressible during operation. Suitable pumps include variable displacement pumps such as a centrifugal or axial flow pumps.

Figure 3:
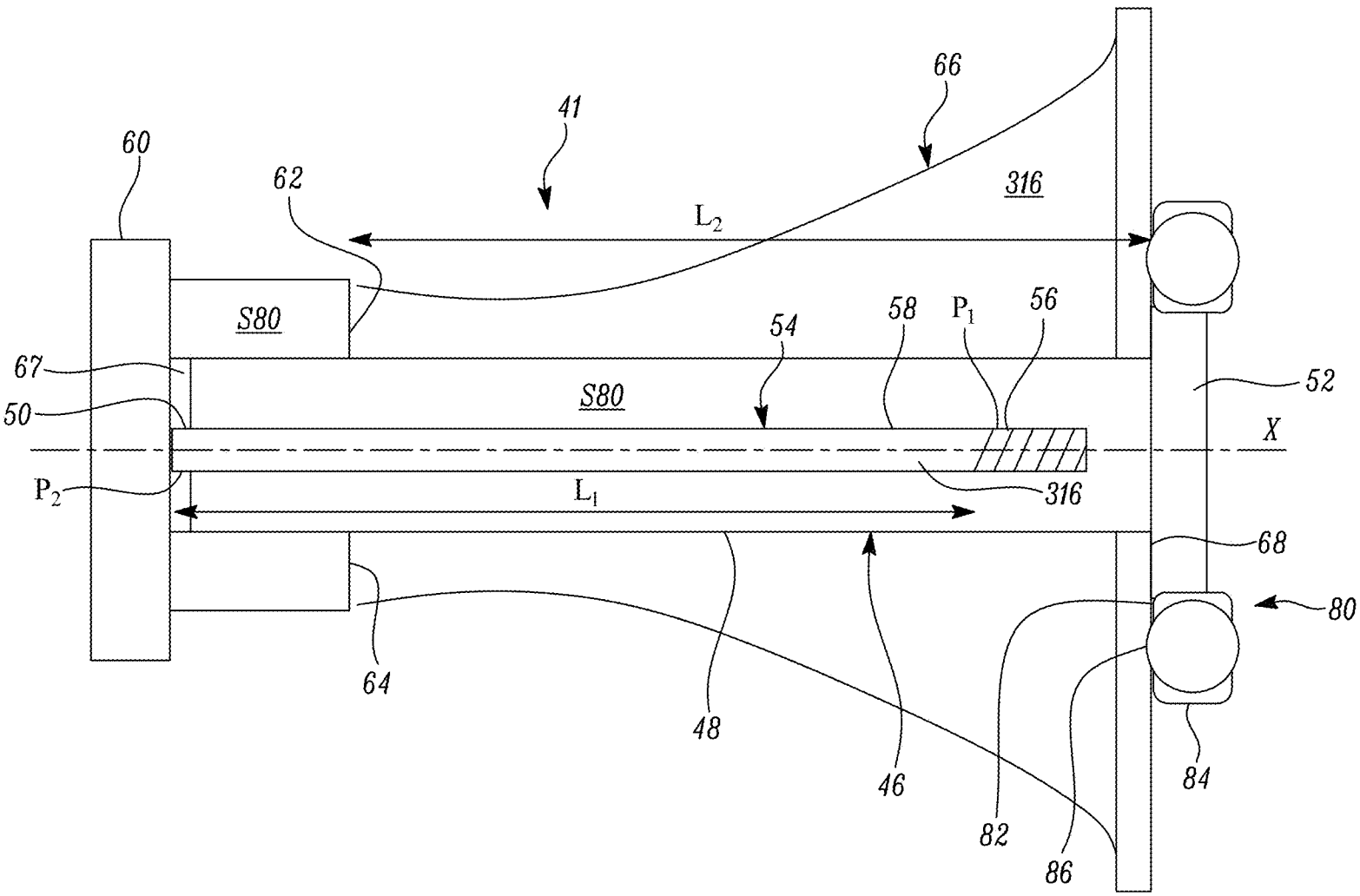
FIG. 3 is a cross-sectional view of part of a fuel pump of the fuel system of FIG. 2.

A first embodiment of an assembly 41 of the high-pressure pump 40 is shown in FIG. 3.

The pump 40 comprises a shaft 46 which is configured to rotate to drive the pump in operation. The shaft 46 comprises an elongate axial portion 48, which defines a rotational axis X about which the shaft 46 is configured to rotate. The shaft 46 also comprises an aperture 50 at a first axial end, and a shoulder 52 projecting radially from the axial portion at a second axial end.

A fastener in the form of a threaded bolt 54 is provided. The bolt 54 comprises a body comprising an externally threaded portion 56 at the second axial end and an unthreaded portion 58 at the first axial end. The bolt also comprises a head 60 located at the first axial end, which projects laterally from the body. The externally threaded portion 56 of the bolt 54 is configured to engage against corresponding internal threads (not shown) of the shaft 46.

The head 60 of the bolt 54 is configured to engage against a first axial surface 64 of an impellor 66 via a spacer 62 provided between the head 60 of the bolt 54 and an axial end of the impellor. The impellor 66 in turn comprises a second axial surface 68 on the opposite side to the first axial surface 64, which is configured to engage against the shoulder 52 of the shaft 46. A small space 67 may be provided between the bolt head 60 and the first axial end of the shaft 46 to allow for some degree of thermal expansion. The gap also ensures that the shaft 46 and bolt head 60 do not contact during use, ensuring that the axial load path always extends through the bolt head 60, spacer 62 and impellor 66 in use.

The shaft 46 is rotatably supported in use by a bearing arrangement 80. The bearing arrangement provides location and support for the shaft 46 to allow for rotation of the impellor arrangement in use. The bearing arrangement comprises an inner race 82, which engages against the shaft 46 or the spacer 62. In some cases, the inner race 82 may form the spacer. An outer race 84 is provided, which engages against a mechanical ground. Each of the races comprises a suitable bearing material such as Cronidur™ 30. Cronidur 30 is defined in specification AMS5898. A bearing 86, such as a roller bearing or ball bearing, is provided between the races 82, 84, and allows for relative rotation thereof. The impellor 66 is in the form of a centrifugal impellor, and is configured to rotate to drive fluid from the first axial end of the pump to the second axial end, and centrifugally outward to energise the flow.

The assembly is assembled as follows. The shaft 46 is inserted into a central hollow portion of the impellor 66 until the shoulder 52 engages against the second surface 68 of the impellor 66. The spacer 62 (where present) is placed at the end of the impellor 66. The bolt 54 is inserted into the aperture 50 until the threaded portion 56 of the bolt 54 engages against the threads of the shaft 46. The bolt head 60 is then turned until the head 60 engages against the spacer 62 (where present) and the spacer 62 engages against the impellor 40, and a predetermined torque is achieved. Alternatively, the bolt head 60 may engage directly against the impellor 66 where the spacer is not present. The impellor assembly is now assembled. The impellor assembly can be inserted into a housing (not shown) to complete the pump 40.

During service, the impellor assembly will experience significant temperature variation. For example, when not in operation, the assembly will typically return to ambient temperature, i.e. between approximately 233 and 323 K. However, when pumping liquid hydrogen, the assembly will be cooled to approximately 20 K. Such large temperature variations may result in the various parts expanding and contracting, which may result in thermal fatigue. This may also result in the thread unlocking, which may cause failure of the assembly.

This is particularly problematic where the pump assembly comprises dissimilar materials, as in the present disclosure.

As will be understood, liquid hydrogen imposes severe material constraints on the pump assembly. The materials used must be compatible both with the chemical properties of hydrogen, and the low temperatures at which the pumps operates. As such, the materials must be resistant to hydrogen embrittlement, and must not become brittle at low temperatures. The materials must also be resistant to fatigue induced by the temperature variations.

Additional material requirements also exist for the different components. In order to withstand the high centrifugal loads in use, the impellor must comprise a material having a high ultimate tensile strength. On the other hand, the shaft must be compatible with bearing surfaces (in particular, have high hardness), while stress in use tends to be lower. As such, it is desirable to form the shaft and impellor from different materials.

The bolt 54 and the impellor 66 are made at least in part of a material having a first Coefficient of Thermal Expansion (CTE). The shaft 46 and optional spacer 62 are made of a second material having a second CTE which differs to that of the first material. In the present disclosure, the first material has a CTE approximately twice that of the second material. In particular, at least the unthreaded portion 58 of the body of the bolt 54 comprises the first material. Similarly, at least the elongate portion 48 of the shaft 46 comprises the second material. As will be understood, the unthreaded portion 58 of the bolt 54 is free to expand and contract axially, and forms the load path between the head 60 and the threaded portion 56, defining an unconstrained axial length $L_1$. Similarly, the elongate portion 48 of the shaft 46 defines the axial extent of contraction and expansion of the shaft 46.

The impellor 66 is also at least partly formed of the first material. In particular, the part of the impellor 66 that experiences the clamping loads, and so forms the load path between the bolt heat 60, spacer 62 and the shaft shoulder 52 is formed of the first material, though in the present embodiment, the impellor 66 is unitary, and entirely formed of the first material. The impellor 66 axial load path between the two opposite clamping loads (i.e. the bolt head 60 or spacer 62 where present, and the shaft shoulder 52) defines a second axial length $L_2$. The first and second lengths $L_1$, $L_2$ are approximately equal to one another, for reasons that will be explained below.

In one example, the first material comprises 316 stainless steel, and the second material comprises S80 stainless steel, as shown in FIG. 3.

S80 is a chromium stainless steel modified by the addition of nickel, and defined by the British Standard Aerospace series of alloys. It is designed to develop high mechanical properties by conventional heat treatment methods and provide good corrosion resistance. This grade is manufactured by electric melting process. Table 1 below gives the composition of this material.

TABLE 1

| Weight (%) | C | Si | Mn | P | S | Cr | Ni |
|---|---|---|---|---|---|---|---|
| Min | 0.12 | | | | | 15.0 | 2.0 |
| Max | 0.20 | 1.0 | 1.0 | 0.030 | 0.025 | 18.0 | 3.0 |

S80 stainless steel has a linear CTE of approximately $6.9\times10^{-6}$ $K^{-1}$.

316 stainless steel, is defined by ISO 4404-316-03-1 for 316L or 4401.316.00-I for 316, which are listed in BS EN 10088-1. 316 stainless steel EN 1.4401 has increased strength and greater creep resistance at higher temperatures compared to 304 stainless steel, and also retains excellent mechanical and corrosion properties at temperatures below 0° C. Table 3 below gives the composition:

TABLE 2

| Weight (%) | C | Mn | Si | P | S | Cr | Mo | Ni | N |
|---|---|---|---|---|---|---|---|---|---|
| Min | | | | | | 16.0 | 2.0 | 10.0 | |
| Max | 0.08 | 2.0 | 0.75 | 0.045 | 0.03 | 18.0 | 3.0 | 14.0 | 0.10 |

316 stainless steel has a linear CTE of approximately $11\times10^{-6}$ $K^{-1}$.

As will be understood, alternative materials could be used for the first and second materials. For example, other grades of stainless steel could be employed which are compatible with hydrogen. Examples are given in PSI PD ISO/TR 15916 "Basic consideration for the safety of hydrogen systems", and include steels such as 310 and A286. Further suitable materials include aluminium and copper.

As will be understood, when the pump assembly is cooled from an ambient temperature of approximately 273 to 323K (0 to 40 C) to an operating temperature of around 20 to 30K, the various components will shrink, including in the axial direction X. Since different materials are used in the construction of the assembly, these different materials will shrink to a different degree, which has the potential to result in excessive stress, or reduction in clamping loads which may result in unlocking of the threads 56, and fretting or misalignment of the impellor 66. In view of the high rotational speed of the pump, this may in turn result in damage to the pump.

However, as a result of the arrangement of the lengths $L_1$, $L_2$ being approximately equal and the bolt 54 and impellor 66 being made of the same material, the impellor and bolt will reduce in axial length by the same extent during contraction as the temperature falls. Accordingly, the clamping loads are maintained, in spite of the difference in thermal contraction of the impellor 66 and shaft 46. As a result, different materials can be used in the construction of the pump assembly, without encountering problematic differential thermal contraction.

The use of different materials between the impellors 66 and shaft 46 provides additional advantages. Since the impellors are formed of a material having a higher CTE than the shaft, the impellors will shrink to a greater degree than the shaft when cooled. As a result, the clearance between the impellors 66 and shaft 54 will reduce during cooling, switching from a clearance to an interference fit as the system cools. Consequently, the assembly can be disassembled easily when warm, but is tightly locked in place at normal operating temperatures.

Figure 4:
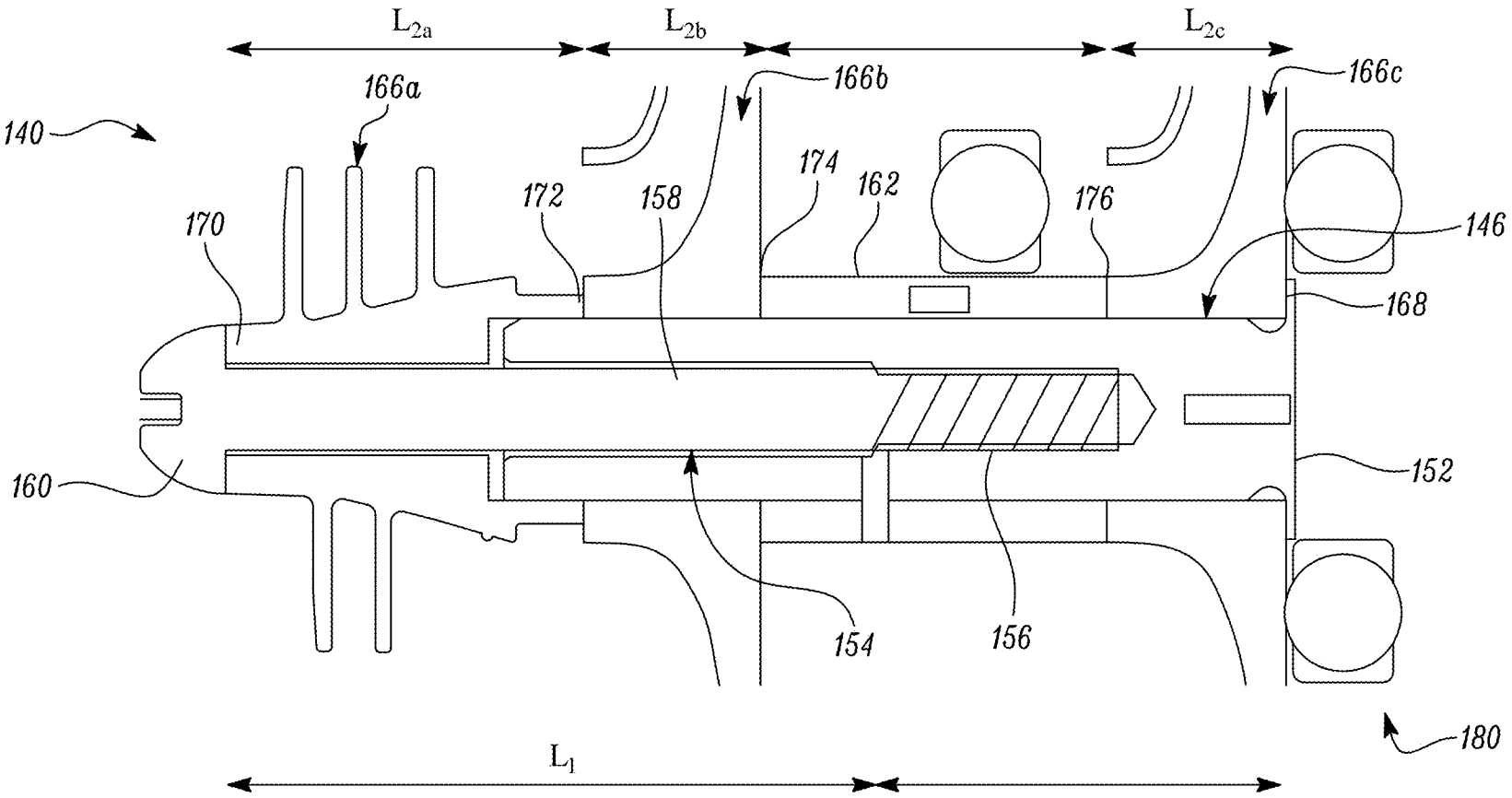
FIG. 4 is a cross-sectional view of part of an alternative fuel pump for the fuel system of FIG. 2.

FIG. 4 shows an alternative pump assembly 140 which operates in accordance with similar principles to the first embodiment shown in FIG. 3.

The assembly 140 again comprises a shaft 146, bolt 154, and in this embodiment, first, second and third impellors 166*a*, 166*b*, 166*c* which are arranged in fluid flow series.

The first impellor 166*a* differs from the impellor 66 of the first embodiment and the second and third impellors 166*b*, 166*c* in that it is an axial flow impellor. Consequently, the impellor 166*a* is configured to drive flow in a principally axial direction. The first impellor 166*a* is provided upstream in hydrogen flow of the second and third impellors 166*b*, 166*c*, and provides an initial head of pressure which aids reduce cavitation in subsequent stages.

The second and third impellors 166*b*, 166*c* are similar to the impellor 66, and are configured to provide the majority of pressure rise in the system. A spacer 162 is provided in between the second and third impellors 166*b*, 166*c*.

As can be seen from FIG. 4, the arrangement of the shaft 146, bolt 154 and impellors 166*a-c* is similar to the first embodiment. However, the addition of the further impellors 166*a*, 166*c* and the placing of the spacer differentiates this embodiment from the first embodiment.

As in the previous embodiment, the bolt comprises threaded and unthreaded portions 156, 158, which are arranged in a similar manner to the first embodiment. As in the first embodiment, the unthreaded portion 158 of the bolt 154 is free to expand and contract axially, and forms the load path between the head 160 and the threaded portion 156, defining an unconstrained axial length $L_1$.

The head 160 of the bolt 154 engages against a first axial surface 170 of the first impellor 166*a* when assembled. The first impellor 166*a* in turn comprises a second axial surface 172, which engages against a corresponding surface of the second impellor 166*b*. The second impellor 166*b* in turn comprises a second axial surface 174, which engages against a corresponding surface 174 of the spacer 162. The spacer comprises a second axial surface 176 which engages against a corresponding axial surface of the third impellor 166*c*, which finally engages against an axial surface of the 168 of the shoulder 152 of the shaft 146. Consequently, a clamping load path is defined by the bolt head 160, first and second impellors 166*a*, 166*b*, spacer 162, third impellor 166*c* and shaft shoulder 168 in series, via the axial surfaces 170, 172, 174, 176, 168.

The assembly is assembled in a similar manner to the first embodiment, with the third impellor 166*c*, spacer 162, second impellor 166*b* and first impellor 166*a* being slid over the shaft 146 prior to insertion of the bolt 154, which is then torqued to the specified value. Again, the assembly is mounted on a bearing assembly 180, which engages with the shoulder 152 of the shaft 146.

As in the previous embodiment, the bolt 154 as well as the impellors 166*a*, 166*b*, 166*c* are each formed of a first material, while the spacer 162 and shaft 146 are formed of a second material. In this embodiment, the first material is 316 stainless steel, while the second material is S80 stainless steel, though again different material choices may be made.

In this case, the clamping load path of the impellors 166*a*, 166*b*, 166*c* is defined by the axial load path extending through lengths $L_{2a}$, $L_{2b}$, $L_{2c}$, and the spacer 162. Similarly, the clamping load path of the bolt 154 is defined by the length $L_1$ of the unconstrained, unthreaded portion 156.

In this embodiment, the sum of the lengths $L_{2a}$, $L_{2b}$, $L_{2c}$ is approximately equal to the length $L_1$. Since the spacer 162 is made of the same material as the shaft 146, the impellors 166*a-c* are made of the same material as the unconstrained length 158 of the bolt 154, and the sum of the lengths $L_{2a}$, $L_{2b}$, $L_{2c}$ of the axial load paths of the impellors 166*a-c* is approximately the same as the length $L_1$ of the unconstrained region 158 of the bolt 154, the bolt and clamped components contract at the same rate, thereby ensuring consistent clamping loads irrespective of temperature.

In one example tested by the inventors, a pump assembly was designed and simulated having an overall length of approximately 100 cm at room temperature (293K). A first impellor 166*a* having an axial clamped length $L_{2a}$ of 29 cm, a second impellor 166*b* having an axial clamped length $L_{2b}$ of 17 cm, a spacer 162 having an axial clamped length of 40 cm, and a third impellor 166*c* having an axial clamped length $L_{2c}$ of 17 cm was provided (all lengths being measured at room temperature). Accordingly, total length $L_{2a}+L_{2b}+L_{2c}$ of 63 cm was defined. A bolt having a unthreaded portion having an axial length of 57 cm. Accordingly, the axial length $L_1$ of the unconstrained length $L_1$ of the bolt 154 is within 10% of the sum of the lengths $L_{2a}+L_{2b}+L_{2c}$. In other embodiments, the length $L_1$ may be within 20% of the sum of the lengths $L_{2a}+L_{2b}+L_{2c}$, though in such a case, a higher degree of variation in clamping loads during cooling must be accepted.

The inventors have found that in such an arrangement, the axial position of the inducer reduces by as much as 0.26 mm when the arrangement is cooled. However, the clamping load is maintained at a constant fixed value, to within less than 0.5% from ambient temperature to operating temperature. Accordingly, strain and therefore fatigue is reduced, and unlocking of the bolt is prevented.

Various examples have been described, each of which comprise various combinations of features. It will be appreciated by those skilled in the art that, except where clearly mutually exclusive, any of the features may be employed separately or in combination with any other features and thus the disclosed subject-matter extends to and includes all such combinations and sub-combinations of the or more features described herein.

Changes may be made to the disclosed embodiment without departing from the invention as defined by the claims. For example, the fastener could be of a different type. Examples include bayonet fasteners, circlips, adhesive and welding. In each case, the fastener would include first and second engagement points, and an unconstrained length therebetween.

The invention claimed is:

1. An impellor assembly for a liquid hydrogen pump, the assembly comprising:

a shaft;

one or more impellors mounted to the shaft;

a fastener configured to engage with the shaft at a first engagement point and with the one or more impellor at a second engagement point to axially clamp the one or more impellor to the shaft, an axially unconstrained length of the fastener being defined by an axial distance between the first and second engagement points; wherein an axial extent of a clamped portion of the one or more impellors corresponds to the axially unconstrained length of the fastener; and the fastener and the impellor comprise a material having a first coefficient of thermal expansion and the shaft comprises a material having a second coefficient of thermal expansion, wherein the first and second coefficients of thermal expansion are different, and wherein the axial distance is within 20% of the axial extent.

2. The impellor assembly according to claim 1, wherein the fastener and impellor are formed of a first material, and the shaft is formed of a second material.

3. The impellor assembly according to claim 1, wherein the fastener comprises a threaded fastener comprising a threaded portion and an unthreaded portion.

4. The impellor assembly according to claim 3, wherein the threaded portion is spaced from a head of the fastener by the unthreaded portion, which may comprise the unconstrained length.

5. The impellor assembly according to claim 3, wherein the threaded portion of the fastener engages against a threaded portion of the shaft.

6. The impellor assembly according to claim 4, wherein the head of the fastener engages against the impellor at the second engagement point comprising a first axial surface of the impellor.

7. The impellor assembly according to claim 6, wherein a shoulder of the shaft engages against a second axial surface of the one or more impellor, opposite the first axial surface.

8. The impellor assembly according to claim 1, comprising a bearing arrangement configured to rotatably support the shaft.

9. The impellor assembly according to claim 1, wherein the impellor and fastener comprise one of 316L stainless steel and aluminium.

10. The impellor assembly according to claim 1, wherein the shaft comprises S80 stainless steel.

11. The impellor assembly according to claim 1, comprising a first impellor and a second impellor.

12. The impellor assembly according to claim 11, wherein a first axial surface of the first impellor engages against a head of the fastener, a second axial surface of the first impellor engage against a first axial surface of the second impellor, and a second axial surface of the second impellor engages against a shoulder of the shaft.

13. The impellor assembly according to claim 1, comprising first, second and third impellors, and each of the impellors may comprise the first material.

14. The impellor assembly according to claim 13, wherein a first axial surface of the first impellor engages against a head of the fastener, a second axial surface of the first impellor engages against a first axial surface of the second impellor, a second axial surface of the second impellor engages against a spacer, the spacer engages against a first axial surface of the third impellor, and a second axial surface of the third impellor engages against a shoulder of the shaft.

15. The impellor according to claim 14, wherein the spacer comprises the second material.

16. A liquid hydrogen pump comprising an impellor assembly according to claim 1, and a housing.

17. A method of assembly of an impellor assembly for a liquid hydrogen pump, the method comprising:

providing an impellor assembly in accordance with claim 1; and using the fastener to axially clamp the impellor to the shaft.

* * * * *